US010300932B2

(12) United States Patent
Meyer et al.

(10) Patent No.: US 10,300,932 B2
(45) Date of Patent: May 28, 2019

(54) CHASSIS FOR A RAIL VEHICLE

(71) Applicant: SIEMENS MOBILITY GMBH, Munich (DE)

(72) Inventors: Heiko Meyer, Creussen (DE); Hans Juergen Maerkl, Stadtbergen (DE)

(73) Assignee: Siemens Mobility GmbH, Munich (DE)

( * ) Notice: Subject to any disclaimer, the term of this patent is extended or adjusted under 35 U.S.C. 154(b) by 101 days.

(21) Appl. No.: 15/327,086

(22) PCT Filed: Jul. 2, 2015

(86) PCT No.: PCT/EP2015/065069
§ 371 (c)(1),
(2) Date: Jan. 18, 2017

(87) PCT Pub. No.: WO2016/008731
PCT Pub. Date: Jan. 21, 2016

(65) Prior Publication Data

US 2017/0166224 A1 Jun. 15, 2017

(30) Foreign Application Priority Data

Jul. 18, 2014 (DE) ..... 10 2014 214 055

(51) Int. Cl.
*B61F 5/38* (2006.01)
*B61F 5/32* (2006.01)
(Continued)

(52) U.S. Cl.
CPC ..... *B61F 5/386* (2013.01); *B61F 3/08* (2013.01); *B61F 5/325* (2013.01); *B61F 5/52* (2013.01); *B61K 9/00* (2013.01)

(58) Field of Classification Search
CPC .. B61F 3/08; B61F 5/325; B61F 5/386; B61F 5/52; B61F 5/38; B61F 5/24; B61F 5/383; B61K 9/00
(Continued)

(56) References Cited

U.S. PATENT DOCUMENTS

2009/0276107 A1* 11/2009 Reimann ..... B61F 5/383 701/19

FOREIGN PATENT DOCUMENTS

CA 2546581 A1 6/2005
CN 201914271 U 8/2011
(Continued)

OTHER PUBLICATIONS

DE 69920527, English translation—Description section—Mar. 2001 (Year: 2001).*

*Primary Examiner* — Mark T Le
(74) *Attorney, Agent, or Firm* — Laurence Greenberg; Werner Stemer; Ralph Locher

(57) ABSTRACT

A chassis for a rail vehicle includes a chassis frame supported on at least first and second wheelsets and one A-frame linkage per wheelset on both sides of the chassis for horizontal axle guidance of the wheelset. Each A-frame linkage is connected in an articulated manner to one of two axle bearings of a wheelset by a wheelset-side bearing and to the chassis frame by two frame-side bearings. At least one of the bearings per A-frame linkage has a hydraulic bushing with variable longitudinal rigidity. The hydraulic bushing has at least one fluid chamber fillable with hydraulic fluid so that in the fluid chamber a hydraulic pressure can form for adjusting longitudinal rigidity. An acceleration sensor per axle bearing measures wheelset acceleration and an adjust-
(Continued)

ment device adjusts hydraulic pressure in at least one of the fluid chambers depending on the measured wheelset acceleration.

8 Claims, 7 Drawing Sheets

(51) Int. Cl.
*B61F 3/08* (2006.01)
*B61F 5/52* (2006.01)
*B61K 9/00* (2006.01)

(58) Field of Classification Search
USPC ..... 105/168
See application file for complete search history.

(56) References Cited

FOREIGN PATENT DOCUMENTS

| | | | |
|---|---|---|---|
| CN | 102407861 | A | 4/2012 |
| CN | 103895665 | A | 7/2014 |
| DE | 4424884 | A1 | 1/1996 |
| DE | 69920527 | T2 | 9/2005 |
| DE | 102010033811 | A1 | 2/2012 |
| DE | 102010052667 | A1 | 5/2012 |
| EP | 0870664 | A2 | 10/1998 |
| EP | 1193154 | A1 | 4/2002 |
| EP | 1457707 | A1 | 9/2004 |
| FR | 2747166 | A1 | 10/1997 |
| RU | 2322366 | C1 | 4/2008 |

* cited by examiner

CHASSIS FOR A RAIL VEHICLE

BACKGROUND OF THE INVENTION

Field of the Invention

In the case of chassis for rail vehicles there is a fundamental conflict of objectives between the dynamic running behavior when traveling round curves and the ride stability for straight-line travel at high speed. This conflict of objectives has already been known for a long time, and in the history of rail technology there have been the most varied approaches to solving it. Particularly in the most recent past, this conflict of objectives has gained renewed importance due to increasing stringency of the conditions for accessing the rail network by the infrastructure operators in Europe and in face of the constant discussion about the introduction of wear-dependent usage charges for the rail network.

From the disclosure document EP 1 193 154 A1, a method and a device are known for stabilizing the hunting oscillations of rail wheelsets. Provision is made that a turning moment is determined, from a metrologically detected acceleration of the wheelset horizontally at an angle to its direction of travel, which is imposed on the wheelset about its vertical axis. For this purpose an actuator, for example, is provided which, for example, can be a servo-hydraulic cylinder with an associated pressure provision (pump and supply storage).

BRIEF SUMMARY OF THE INVENTION

The object underlying the invention can be seen as being to make available an improved chassis for a rail vehicle.

The object underlying the invention can also be seen as being to make available a corresponding method for operating a chassis for a rail vehicle.

The object underlying the invention can be seen as being to make available a corresponding rail vehicle.

The object underlying the invention can also be seen as being to specify a corresponding computer program.

These objects are achieved by means of the relevant subject of the independent claims. Advantageous embodiments of the invention are the subject in each case of dependent sub-claim.

From one point of view a chassis is made available, for a rail vehicle, comprising:

- a chassis frame which is supported on at least one first wheelset and one second wheelset,
- for each wheelset on each of the two sides of the chassis an A-frame linkage for horizontal guidance of the axle of the wheelset, wherein
- each A-frame linkage has articulated joints to one of two axle bearings of a wheelset, formed by a bearing on the wheelset side, and to the chassis frame by two bearings on the chassis side, wherein
- for each A-frame linkage at least one of the bearings has a hydraulic bushing with a longitudinal stiffness which can be altered, wherein
- the hydraulic bushing has at least one fluid chamber which can be filled with a hydraulic fluid so that a hydraulic pressure can build up in the fluid chamber, by which the longitudinal stiffness can be adjusted,
- for each axle bearing an acceleration sensor for measuring an acceleration of the wheelset,
- an adjusting device for adjusting the hydraulic pressure in at least one of the fluid chambers as a function of the measured wheelset acceleration.

In accordance with a further aspect, a method is provided for operating the inventive chassis for a rail vehicle, comprising the following steps:

- measure a wheelset acceleration for each wheelset, by means of the acceleration sensors,
- adjust the hydraulic pressure in at least one of the fluid chambers as a function of the measured wheelset acceleration.

In accordance with yet another aspect, a rail vehicle is provided which comprises the inventive chassis.

In accordance with yet another aspect, a computer program is specified which comprises program code for carrying out the inventive method when the computer program is executed on a computer.

The invention thus encompasses in particular the idea of adjusting the longitudinal stiffness of a hydraulic bushing, of a bearing in an A-frame linkage, in that a particular hydraulic pressure is set in the hydraulic bushing, more precisely in the fluid chamber. By means of the active adjustment of the longitudinal stiffness it is thus advantageously possible to actively influence the hunting oscillations. These can be detected indirectly via a measurement of the wheelset accelerations. Since the adjustment is effected on the basis of, or dependent on, the wheelset accelerations, the hunting oscillations can be influenced in such a way that optimal track-following can be effected combined with minimal wear.

The hunting oscillations of the wheelset result from the vehicle alignment on the rails, and arise from the existing contact geometry between the wheel profile and the rail profile which, simplifying it, corresponds to a cone the outer surface of which rolls over a plane. The cone will then always roll on a circular path, determined by its angle. Here, to simplify, the wheelset corresponds to two cones arranged in opposition and rigidly joined together by an axle. In this case, as its two wheels roll along, rigidly joined together by the wheelset axle, the wheelset constantly wishes to make the advantageous attempt to adjust itself on a radial arc on the track (also on straight sections). Due to this radial setting, each of the two wheels rolls on different rolling radii on the track, so that what is known as a wheelset turning moment is generated which is in the opposite sense from its angular setting, which has as a consequence a radial setting in the opposite direction. The actual contact geometry between the wheel and rail is more complex, and has a non-linear behavior. The expression used here is so-called equivalent conicity. However, here again a hunting oscillation of the wheelset results from the difference in rolling radii, but this however no longer corresponds to a pure sine function. In order nevertheless to permit the desired radial setting of the wheelset it is aligned by the axle guide (A-frame) in such a way that a lateral displacement and an angular setting and turning movement about its vertical axis is possible. The hunting oscillation frequency is here dependent on the vehicle speed and the construction of the stiffness of the axle guide longitudinally and laterally relative to the vehicle's longitudinal axis. A soft axle guide is favorable to the turning movement, and hence to the radial setting capability of the wheelsets, that is the positive arc-following behavior on curved tracks with a relatively low travel speed, but during straight-line travel at high vehicle speed leads to unstable hunting oscillations.

In the case of a stiff axle guide, the wheelset has stable behavior on straight stretches, but its radial adjustment on track curves is made more difficult.

Together with the traction or braking forces, as applicable, from the drive and brake in the vehicle, the turning moments on the wheelset thus generated during the vehicle's travel on a track result in corresponding forces and accelerations which act longitudinally, laterally and as a turning moment about the vertical axis of the wheelset.

In accordance with the invention, therefore, this hunting oscillation is actively influenced in that the longitudinal stiffness of the hydraulic bushing is altered by means of an adjustment to the hydraulic pressure in the fluid chamber. In this way, an unfavorable hunting oscillation can be compensated, so that wear can be minimized and so that stable straight-line travel can be effected.

In accordance with one form of embodiment, provision is made that the adjustment device is designed to set a predetermined path over time for the hydraulic pressure, as a function of the measured wheelset acceleration, in order to impose on the wheelset a turning moment with a corresponding path over time.

In accordance with a further form of embodiment, provision is made that the adjustment device is designed, by adjusting the hydraulic pressure in the fluid chamber, to actively impose on the wheelset to which this fluid chamber corresponds a turning moment. By this means the technical advantage is achieved, in particular, that active steering is possible by adjustment of the hydraulic pressure. The turning moment can advantageously compensate for an unstable travel progress.

In another form of embodiment, provision is made that the bearing with the fluid chamber is the bearing on the wheelset side.

In accordance with a further form of embodiment, provision is made that the adjustment device has a pressure reservoir which can be connected to the fluid chamber. This produces the technical advantage, in particular, that a hydraulic pressure which is not at that moment required can be temporarily stored in the pressure reservoir, so that it can be reused at a later point in time in order then to adjust the hydraulic pressure in the fluid chamber. The pressure reservoir is constructed, in particular, to accept and reoutput the hydraulic fluid. That is to say that the pressure reservoir takes up and reoutputs, in particular, the hydraulic fluid. This is controlled, in particular, by means of the adjustment device. For example, a valve, for example an on-off valve, is provided between the fluid chamber and the pressure reservoir. In this way, the advantageous effect is achieved that the pressure reservoir can be connected up to and again disconnected from the fluid chamber.

In accordance with yet another form of embodiment, provision is made that the adjustment device has a pressure generation device which can be connected to the fluid chamber. This gives the technical advantage, in particular, that if additional hydraulic pressure is required in the fluid chamber this can be generated by means of the pressure generation device. Hence a particular pressure level can be ensured. In particular, this gives the technical advantage that it is possible to actively build up a pressure in the fluid chamber. This, in particular, against a flow of fluid which, in particular, is unavoidably produced due to the movement of the rail vehicle.

Because, due to the hunting oscillations, particular wheelset guidance forces arise which enforce hydraulic fluid flows. Thus the hydraulic fluid will respectively flow out of the fluid chamber or flow into it, depending on the wheelset guidance forces. This in- and out-flow can now be actively controlled or influenced. This is, in particular, an essential idea of the invention.

In accordance with a further form of embodiment, the frame-side bearings have elastomer bushings with a constant longitudinal and lateral stiffness, and the wheelset-side bearing have hydraulic bushings with a constant lateral stiffness, and variable longitudinal stiffness.

In accordance with one form of embodiment, the bearings of each A-frame linkage are arranged in each case at the corners of a horizontally aligned triangle with equal arm lengths, the apex of which forms the wheelset-side bearing and the base of which forms the frame-side bearing. By the symmetrically-distributed arrangement of the bearings relative to the longitudinal direction, at the corners of an isosceles triangle, one achieves a particularly high lateral stiffness of the A-frame linkage, which is determined for example by the properties of the elastomer in the bearings.

In another form of embodiment, provision is made that each hydraulic bushing has a fluid chamber which lies outside in the longitudinal direction and a fluid chamber which lies inside in the longitudinal direction, which are arranged to lie opposite each other in the longitudinal direction and can be filled with hydraulic fluid, wherein there is connected to each fluid chamber a fluid channel for the in- or out-flow respectively of hydraulic fluid respectively into or out of the fluid chamber, wherein the adjustment device is hydraulically coupled to the fluid channels and is constructed to adjust an in- or out-flow respectively of hydraulic fluid, so that it is possible to adjust the hydraulic pressure in the fluid chambers by means of outflows or inflows respectively of hydraulic fluid.

As already explained above, certain wheelset guidance forces arise from the hunting oscillations, which enforce hydraulic fluid flows. Provision is now made in accordance with the invention that these in- and out-flows are actively controlled and/or influenced. For example, valves which can be controlled are provided in the fluid channels. In particular, these valves can be opened and/or closed and/or controlled in such a way that a flow cross-section in the fluid channel is altered, that is for example enlarged or reduced. This advantageously allows an adjustment of a longitudinal stiffness to be adjusted in an advantageous manner. By this means, it is possible in an advantageous way to impose on the wheelset a particular turning moment. This can, for example, compensate a hunting oscillation in such a way that wear and/or noisy travel is minimized.

Lying inside and lying outside are here defined in relation to the longitudinal direction, which is defined as running parallel to the direction of travel or the rails. In the longitudinal direction, the first and second wheelsets are arranged one behind the other—expressed otherwise they are on the two sides of the center of a chassis—wherein a fluid chamber lying on the inner side faces towards the center of the chassis and a fluid chamber lying on the outer side faces away from the center of the chassis.

In accordance with a further form of embodiment, provision is made that hydraulic bushings which are arranged on the same side of the chassis are connected via external fluid channels in such a way that there is a hydraulic coupling from the outwardly-lying fluid chambers of the first wheelset to the inwardly-lying fluid chambers of the second wheelset and from the inwardly-lying fluid chambers of the first wheelset to the outwardly-lying fluid chambers of the second wheelset, wherein the adjustment device is hydraulically coupled to the external fluid channels.

In accordance with yet another form of embodiment, provision is made that each of the hydraulic bushings has in each case an internal fluid channel via which the outwardly-lying fluid chamber and the inwardly-lying fluid chamber on the same hydraulic bushing are hydraulically coupled, wherein the adjustment device comprises on/off valves, wherein an on/off valve is assigned to each internal fluid channel, by means of which the flow of hydraulic fluid through the fluid channel can be adjusted.

In the sense as intended by the present invention, inside means in particular that an internal fluid channel runs inside the hydraulic bushing. But inside, in the sense of the present invention, also means that such an internal fluid channel, while it may run outside the hydraulic bushing, does however exclusively link or hydraulically couple the fluid chamber which lies inside with the fluid chamber which lies outside on the same hydraulic bushing.

The forms of embodiment cited above in connection with the internal fluid channel and the external fluid channel can, in accordance with another form of embodiment, be provided as alternative forms of embodiment. That is to say, in particular, that there is a hydraulic decoupling between the fluid chambers of the same hydraulic bushing and an exclusively hydraulic coupling of the fluid chambers of several hydraulic bushings, as described in connection with the external fluid channels. As an alternative to this form of embodiment, there is a hydraulic decoupling of the fluid chambers of one hydraulic bushing from the fluid chambers of a further hydraulic bushing, and an exclusive coupling of the fluid chambers of the one and same hydraulic bushing, as described in connection with the internal fluid channels. In a further alternative form of embodiment, the individual fluid chambers of the hydraulic bushings are coupled with each other as above in connection with the external and internal fluid channels, wherein however in the fluid channels, that is in both the external and/or the internal fluid channels, valves are provided, for example on/off valves, in such a way as to effect the relevant coupling states by these valves being correspondingly respectively closed or opened. It is thereby advantageously possible, depending on the desired requirement, to switch in a particular coupling state (only the fluid chambers of the one and same hydraulic bus being hydraulically coupled, or the fluid chambers of several hydraulic bushings being coupled with each other, as explained above in connection with the external fluid channels).

In accordance with a further form of embodiment, provision is made that a pressure sensor is provided for measuring a hydraulic pressure in the fluid chamber. By this means, the technical advantage is achieved, in particular, that a pressure drop can be detected. It is then advantageously possible to initiate suitable measures, for example a warning.

In a preferred form of embodiment of the inventive chassis, each fluid chamber which is coupled via a fluid channel is assigned a pressure sensor, which reacts in the event that the pressure prevailing in the hydraulic fluid drops below a prescribable threshold value, wherein the pressure sensors are linked individually and/or serially with a pressure monitoring device, and wherein the pressure monitoring device is designed to transmit a warning signal to a central control device if an individual and/or all the pressure sensors is/are triggered. This makes possible a diagnosis in the event of a failure of the hydraulic system. The pressure sensors measure the pressure prevailing in the coupled fluid chambers, wherein a switch is closed as soon as the pressure drops below a threshold value. In the case when the pressure sensors are connected separately to the pressure monitoring device, it is there possible to determine separately for each hydraulic bushing whether there is a critical pressure drop. If the pressure sensors are connected in series to the pressure monitoring device, it is there possible to determine whether there is a critical pressure drop in the hydraulic bushings collectively. Depending on what is determined, a warning signal about the critical pressure drop can be output to a central control device of the rail vehicle. By this means the operational safety of the rail vehicle can be assured.

In another advantageous form of embodiment of the inventive chassis, there is a third wheelset arranged between the first wheelset and the second wheelset. The invention, which has up to here been described for a two-axle chassis, can also be applied for a three-axle chassis in which a further, third, inner wheelset, is arranged between the first and the second wheelset as outer wheelsets. In that the radial setting of the outer wheelsets is effected by A-frames in accordance with the invention, the third, inner, wheelset will in any case adopt a radial setting.

In accordance with one form of embodiment, a fluid channel is in the form of a rigid pipe or a flexible hose. In the case of several fluid channels, the fluid channels may, in particular, be the same or, for example, different in form.

In accordance with one form of embodiment, the rail vehicle is a locomotive, a traction unit, a streetcar, an underground vehicle or a suburban rail vehicle.

Forms of embodiment in connection with the chassis apply analogously for forms of embodiment in respect of the method, and vice versa. That is to say, the features and/or advantages as described in connection with the chassis apply analogously for the method, and vice versa.

BRIEF DESCRIPTION OF THE SEVERAL VIEWS OF THE DRAWING

The characteristics, features and advantages of this invention described above, together with the way and manner in which they are achieved, will become more clearly and more plainly comprehensible in conjunction with the following description of the exemplary embodiments, which are explained in more detail in conjunction with the drawing, wherein.

DESCRIPTION OF THE INVENTION

In what follows, it has been possible to use the same reference marks for the same features. Furthermore it has been determined that, for the sake of overall clarity, not all the reference marks for individual features will be shown in all the drawings.

Figure 1:
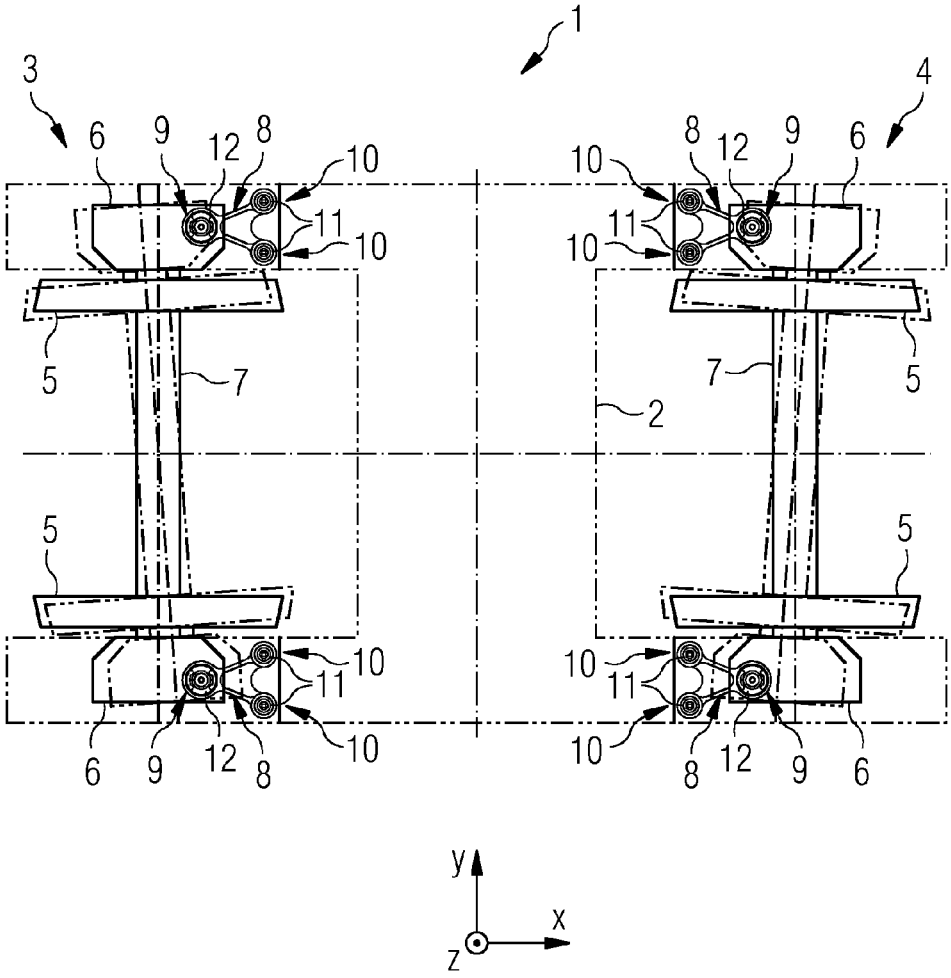
FIG. 1 shows a plan view of a two-axle exemplary embodiment of the inventive chassis.
Figure 2:
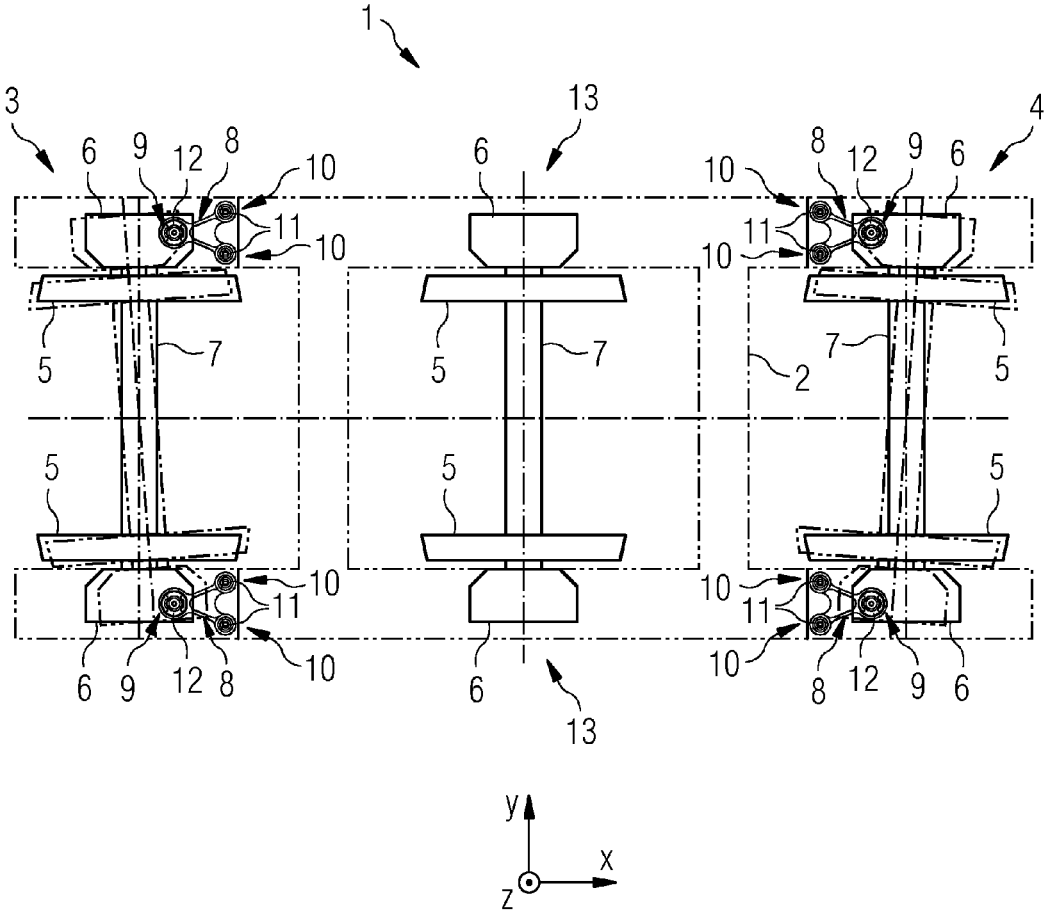
FIG. 2 shows a plan view of a three-axle exemplary embodiment of the inventive chassis.

A chassis 1 in accordance with the invention, on which a carriage body, not shown, of a rail vehicle, for example a locomotive, has a sprung support so that it can rotate about a vertical axis, has as shown in FIG. 1 and FIG. 2 a chassis frame 2. The chassis frame 2 is supported at least on a first wheelset 3 and a second wheelset 4, which are together designated in what follows as wheelsets 3 and 4. Each of the wheelsets 3 and 4 has two rail wheels 5 which are joined by a wheel axle 7 mounted in two axle bearings 6. For the purpose of horizontal guidance of the wheelsets 3 and 4, each of these is linked onto the chassis frame 2 on both sides of the chassis via A-frame linkages 8. Here, each of the A-frame linkages 8 has articulated linkages to an axle bearing 6 by a bearing 9 on the wheelset side and to the chassis frame 2 by two bearings 10 on the frame side. The frame-side bearings 9 have elastomer bushings 11 with constant longitudinal and lateral stiffness, and the wheelset-side bearing 10 has hydraulic bushings with a constant lateral stiffness and alterable longitudinal stiffness. The bearings 9 and 10 of each A-frame linkage 8 are arranged in each case on the corners of a horizontally oriented isosceles triangle, the apex of which is formed by the wheelset-side bearing 9 and the base by the frame-side bearings 10. The bearings 9 and 10 of each A-frame linkage 8 are arranged in each case on the corners of a horizontally oriented isosceles triangle, the apex of which is formed by the wheelset-side bearing 9 and the base by the frame-side bearings 10. Unlike the two-axle chassis 1 shown in FIG. 1, a three-axle chassis as shown in FIG. 2 has a third wheelset 13, which in the longitudinal direction X is arranged between the first wheelset 3 and the second wheelset 4, and is joined with the chassis frame 2. When the rail vehicle is traveling round a curve, the outer wheelsets 3 and 4 are aligned radially to the arc of the track, indicated in FIG. 1 and FIG. 2 by a dash-dot line. For this purpose, the hydraulic bushings 12 have a low longitudinal stiffness at low travel speeds, while at high travel speeds on largely straight line tracks they have a high stiffness, which leads to a high ride stability. This longitudinal stiffness can be adjusted, as explained below in more detail. For this purpose, acceleration sensors and an adjustment device are provided, as is illustrated and described below in conjunction with FIGS. 6 and 7.

Figure 3:
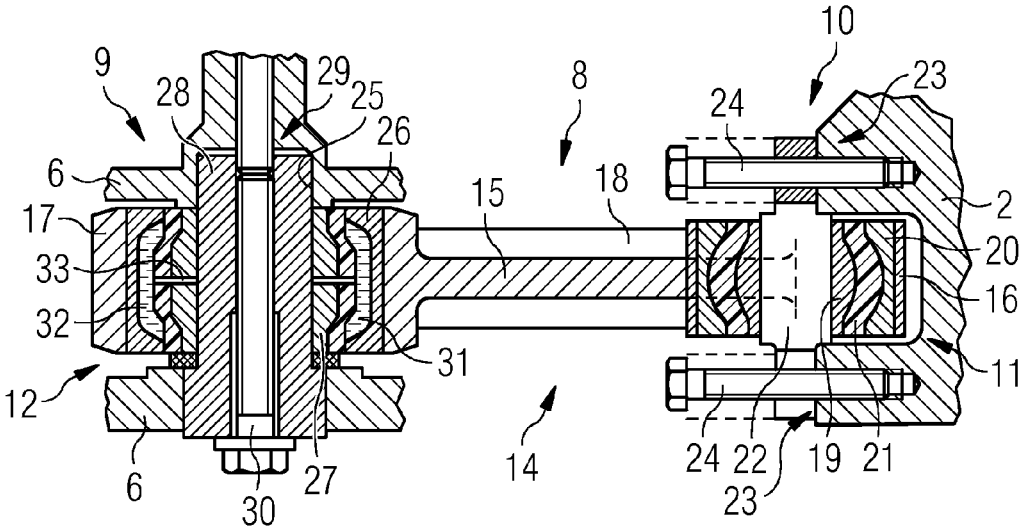
FIG. 3 shows a partially sectioned side view of an A-frame linkage.
Figure 4:
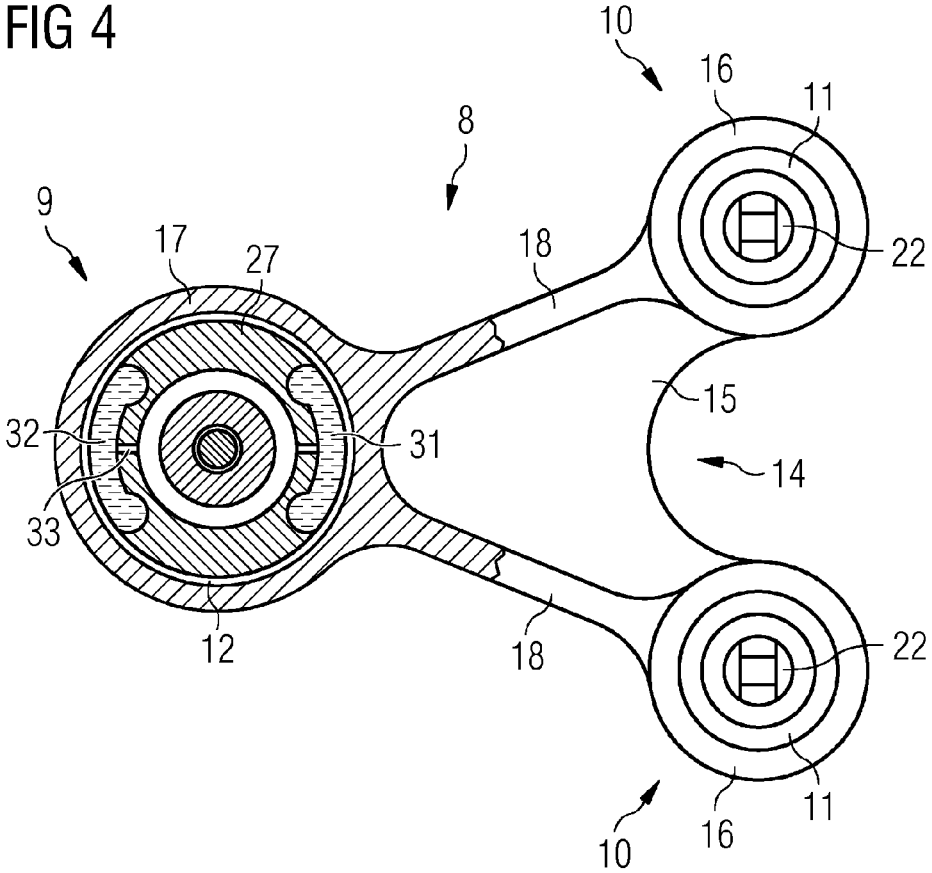
FIG. 4 shows a plan view of the A-frame linkage as shown in FIG. 3.

As shown in FIG. 3 and FIG. 4, each of the A-frame linkages 8 has a linking body 14, the joining web 15 of which extends horizontally and joins together two smaller linkage eyes 16 for accommodating elastomer bushings 11 and a larger linkage eye 17 for accommodating the hydraulic bushing 12. The linking body 14 can be in the form of a cast part or a forged part or a milled part. Optionally, formed onto and protruding from the side edges of the linking web 15 which join the larger linkage eye 17 to the smaller linking eyes 16 are vertical joining ridges 18. Each elastomer bushing 11 has an inner bearing shell 19, an outer bearing shell 20 and an elastomer bushing 21 embedded between them. Because of the rotationally symmetrical structure of the elastomer bushing 11, it has a constant stiffness in the longitudinal direction X and the lateral direction Y. The outer bearing shell 20 sits in the smaller linkage eye 16, while a vertically oriented bearing bolt 22 passes through the inner bearing shell 19. On each of the two ends of the bearing bolt 22 which project out of the inner bearing shell 19 there are two planar seating surfaces, lying parallel to each other, into the face of which is worked in each case a horizontally oriented through-hole 23. These through-holes 23 provide for the fixing device 24 to pass through them, to join the frame-side bearing 10 to the chassis frame 2 above and below the elastomer bushing 11. Each hydraulic bushing 12 also has an inner bearing shell 25, an outer bearing shell 26 and embedded between these a ring-shaped elastomer element 27. The outer bearing shell 26 sits in the larger linkage eye 17, while a bearing bolt 28 passes through the inner bearing shell 25 vertically. The bearing bolt 28 has a vertically-oriented through-hole 29 through which the fixing device 30, for joining the bearing 9 on the wheelset side to the axle bearing 6, passes coaxially through the hydraulic bushing 12. On sides which are opposite to each other in the longitudinal direction X, the elastomer element 27 and the outer bearing shell 26 form two segment-shaped hollow spaces, of which the hollow space facing the elastomer bushings 11 forms a fluid chamber 31 on the inner side and the hollow space facing away from the elastomer bushings 11 forms a fluid chamber 32 on the outer side. The fluid chambers 31 and 32 are linked to each other by an internal fluid channel 33, and are filled with a hydraulic fluid. By this means, the fluid chambers 31 and 32 on the inner and outer sides are hydraulically coupled in such a way that hydraulic fluid which flows out of one of the fluid chambers 31 or 32 due to an externally imposed pressure flows into the other fluid chamber, 32 or 31. The imposed pressures arise from guidance forces between the axle bearings 6 of the wheelsets 3 and 4 and the chassis frame 2, which are transmitted by the A-frame linkages 8 and can lead to an exchange of fluid between the fluid chambers 31 and 32 in the hydraulic bushings 12. In accordance with the invention, this exchange of fluid is actively influenced, as explained further below.

Figure 5:
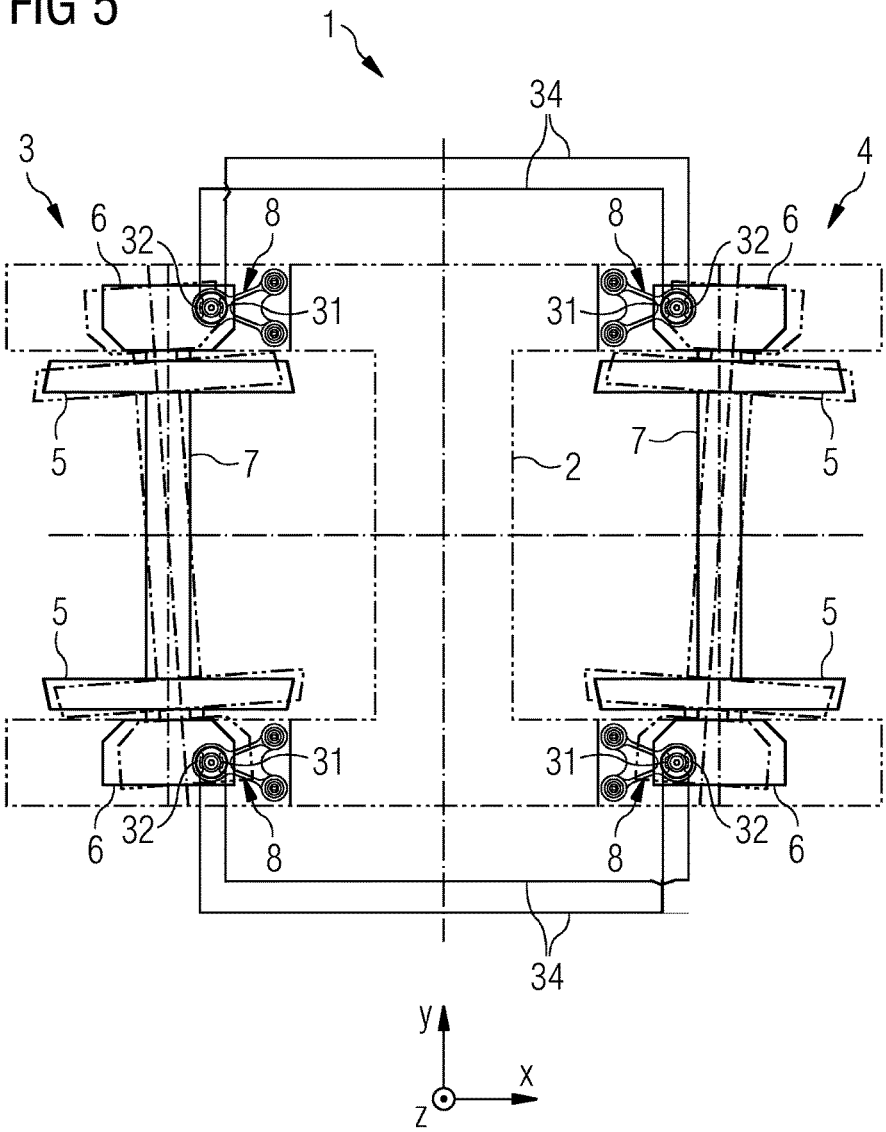
FIG. 5 shows a plan view of another two-axle exemplary embodiment of the inventive chassis.

What is critical for the longitudinal stiffness c (on the assumption that no active influence is exercised on the fluid flows) of the hydraulic bushings 12 is here the frequency f at which lateral accelerations are evoked in the elastomer element 27 from outside by the hunting oscillations of the wheelsets 3 and 4. Apart from a high lateral stiffness, the hydraulic bushings 12 have a variable longitudinal stiffness c which is dependent on the excitation frequency, the nature of which is indicated in FIG. 5. Low frequencies f, which occur at low travel speeds of the rail vehicle, for example while traversing a curve, are associated with a low longitudinal stiffness $c_{low}$; the bearings 9 on the wheelset side are then soft, so that a radial adjustment of the wheelsets 3 and 4 is possible on the track curve by a fluid exchange. At high travel speeds of the rail vehicle, when traveling in a straight line, high excitation frequencies f arise, which are associated with a high longitudinal stiffness $c_{high}$; the bearings 9 on the wheelset side are then hard, so that the ride stability of the chassis 1 is increased. The speed of the fluid exchange between the fluid chambers 31 and 32 here depends on the flow resistance of the internal fluid channel 33, which is essentially determined by its path and cross-sectional area.

In the form of embodiment as shown in FIG. 5, the fluid chambers 31 and 32 are not joined internally in a hydraulic bushing, but via external fluid channels 34 which can be made as rigid hydraulic piping or flexible hydraulic hose. The hydraulic bushings 12 which are arranged on the same side of the chassis are here connected by two external fluid channels 34 in such a way that the outwardly-lying fluid chamber 32 on the first wheelset 3 is hydraulically coupled with the inwardly-lying fluid chamber 31 on the second wheelset 4, and the inwardly-lying fluid chamber 31 on the first wheelset 3 is hydraulically coupled with the outwardly-lying fluid chamber 32 on the second wheelset 4. This coupling is effected on the two sides of the chassis symmetrically relative to the longitudinal direction, thereby improving the radial setting of the wheelsets 3 and 4 on track curves and ensuring the necessary high longitudinal stiffness c when starting up with high tractive force or when braking, as applicable. During the start-up or braking of the wheelsets 3 and 4, the bearings 9 on the wheelset side are subject to forces with the same sense, so that no fluid exchange arises between the coupled fluid chambers 31 and 32—the bearing 9 has a hard reaction. When traversing curves, the forces which arise have the opposite sense, so that hydraulic fluid is exchanged between the coupled fluid chambers 32 lying on the inside and on the outside, and because of the soft reaction of the bearings a radial adjustment of the wheelsets 3 and 4 can occur. The advantage of this concept consists in a good transmission of pull/push forces.

In the embodiments described above the assumption has been made that the fluid flows in or out of the fluid chambers, as applicable, solely because of the wheelset guidance forces. However, in accordance with the invention provision is made that active influence is exercised on the flow behavior of the hydraulic fluid. This will be explained in more detail in what follows.

Figure 6:
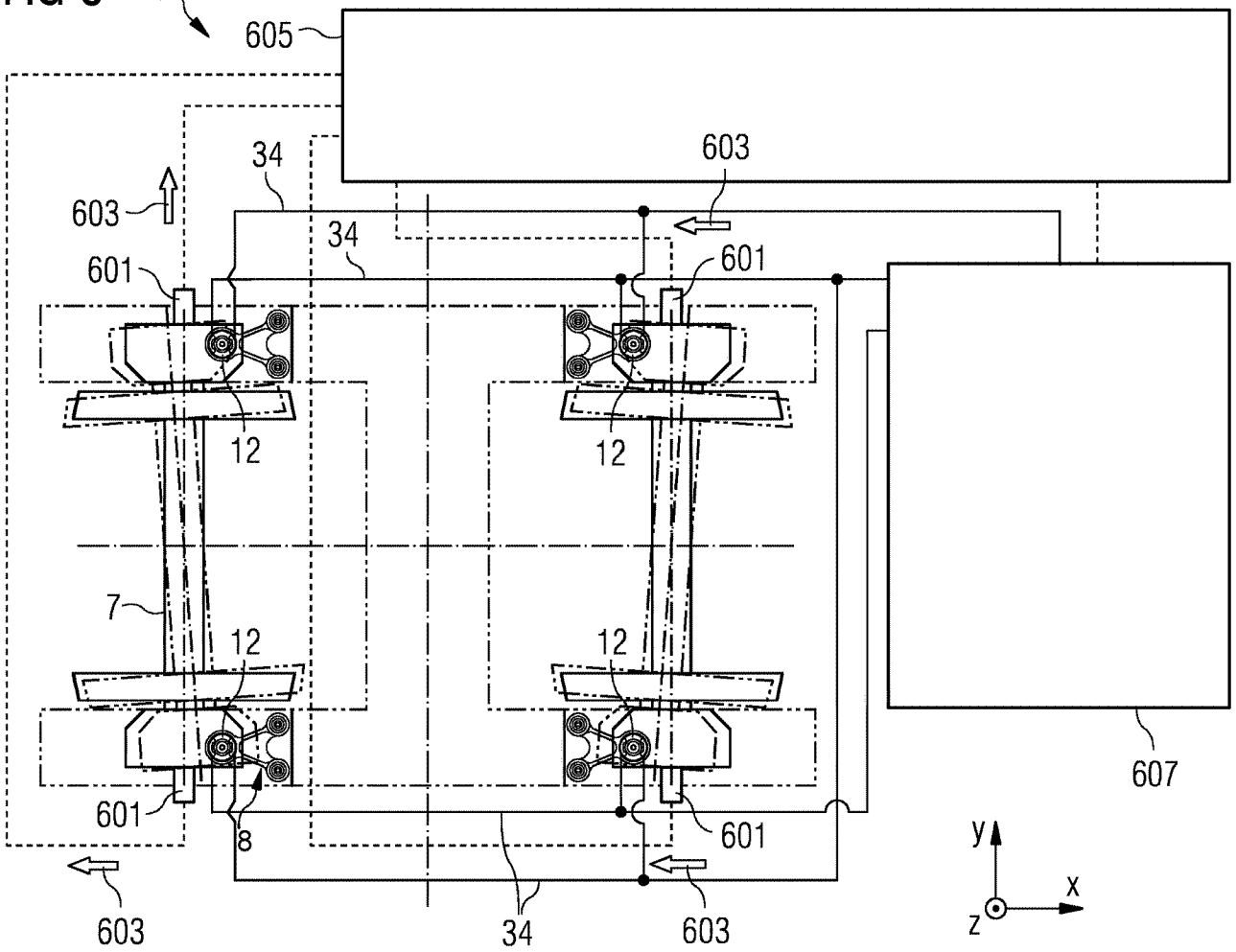
FIG. 6 shows the chassis as shown in FIG. 5, with further details.

FIG. 6 shows the chassis 1 as in FIG. 5, with further details.

Thus, drawn in FIG. 6 are the acceleration sensors 601 which are designed to measure an acceleration of the wheelset. For this purpose, an acceleration sensor 601 is provided for each axle bearing 6. The acceleration sensors 601 measure an acceleration in the x- and y-direction, together with a rotational acceleration about the z-axis. Correspondingly, the acceleration sensors 601 output acceleration signals 603. This is indicated symbolically by the arrows with the reference marks 603.

The acceleration signals 603 are fed to a regulatory device 605. This filters the acceleration signals 603, in particular in real time, as a function of the stiffness relationships of the A-frame linkages 8, of the hydraulic bushings 12 and the individual pipes of the hydraulic system, that is in particular the external channels 34, where these stiffness relationships are stored in the regulatory device 605 as benchmarks, so that the filtered acceleration signals can be used as the basis for regulation of the longitudinal stiffness. From the accelerations thus filtered and appropriate setpoint values, the regulatory device 605, which can for example be in the form of a PI regulator, forms a difference signal which supplies the regulating variable for a pressure generating device 607, which comprises a hydropulser, not shown, and a pressure generator, not shown. Together with a pressure generator, the hydropulser forms a hydraulic pressure signal, which is suitable for influencing highly dynamic hunting oscillations of the wheelsets 3 and 4 and to influence accordingly their setting on the track. For a suitable switching frequency (, which is determined) of the fluid chambers 31 and 32 one can thereby, when the vehicle's travel is unstable, advantageously stabilize the wheelsets 3 and 4 by means of the A-frame linkages 8 and hydraulic bushings 12 by imposing a frequency pattern which is counter-phase with the hunting oscillations. In particular, on sharp track curves one can then, by suitable hydraulic switching of the fluid chambers 31 and 32, effect active steering of the wheelsets 3 and 4 for the purpose of optimizing the track guidance and minimizing wear of the wheel running surfaces. The suitable switching frequency is determined, in particular, as a function of the measured wheelset accelerations.

That is to say, the pressure generation device 607 can set a hydraulic pressure in the fluid chambers 31 and 32 of the individual hydraulic bushings 12. This, in particular, as a function of the measured acceleration signals 603. For this purpose, the regulatory device 605 comprises a signal filter for the acceleration signals 603, in particular a real-time signal filter. In particular, the regulatory device 605 comprises a signal computer with a measured value converter, in particular a real-time signal computer with a measured value converter. The regulatory device 605 comprises in addition a difference calculator with a PI regulator and a setpoint value output for a pulse signal converter. Hence the regulatory device 605 comprises in particular a pulse signal converter with a valve control unit for controlling valves, in particular on/off valves 604. For the sake of clarity, only one of these valves is shown in FIG. 6.

The pressure generation device 607 comprises in addition a hydraulic pulser, which works as an energy converter and generation unit for the required control pulse pattern and for the hydraulic pressure for the hydraulic bushings 12 in the A-frame linkages 8. In one form of embodiment, which is not shown, a separate pressure generator and/or a separate pressure reservoir are provided, to ensure the required hydraulic pressure level for an active stability regulation and steering of the wheelsets 3 and 4.

In one form of embodiment, which is not shown, pressure monitoring is provided, with one pressure sensor for each coupled fluid chamber 31, 32. By this means, a diagnosis is advantageously made possible in the event of a failure, a leakage.

So, in FIG. 6 the fluid chambers 31, 32 in the one and same hydraulic bushing 12 have no hydraulic connection between them. Rather they are coupled to each other as described above in conjunction with FIG. 5. This advantageously results in the possibility of exercising active hydraulic control over the forces and accelerations and turning moments which result because of the wheelset guidance forces, and thereby to actively influence the hunting oscillations of the wheelsets 3, 4 which inherently arise on the track. In doing this, the fluid chambers 31, 32 of the hydraulic bushings 12 on the A-frame linkages 8 of the wheelsets 3, 4 are in each case switched together in such a way that the hydraulic pressure prevailing in them effects either a stiffening or a softening of the hydraulic bearings.

The regulatory device 605 and the pressure generation device 607 form an adjustment device for setting a hydraulic pressure in the fluid chambers 31, 32.

Figure 7:
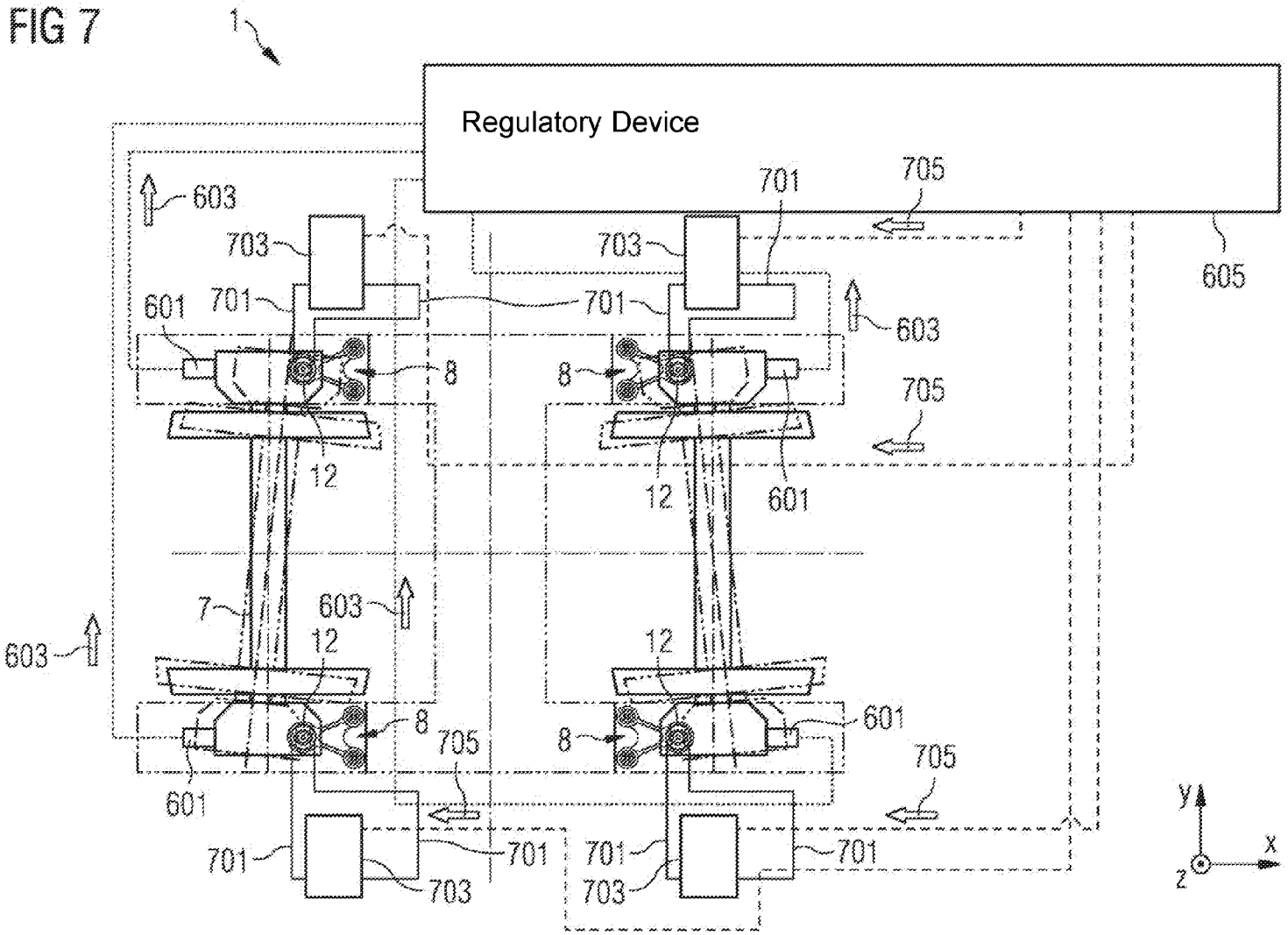
FIG. 7 shows the chassis as shown in FIG. 1, with further details.

FIG. 7 shows the chassis 1 as shown in FIG. 1, with further details.

Analogously to FIG. 6, here again those individual acceleration sensors 601 are now shown which feed appropriate acceleration signals 603 to the regulatory device 605. This latter is constructed, in particular, analogously to the regulatory device 605 as shown in FIG. 6. Reference can be made to the appropriate explanations.

In the forms of embodiment shown in FIG. 7, the individual fluid chambers 31, 32 of the one and same hydraulic bushing 12 are only coupled hydraulically between each other. The fluid chambers 31, 32 of the hydraulic bushings 12 are, however, not hydraulically coupled between each other. This is unlike the hydraulic coupling as shown in FIG. 6. For the hydraulic coupling of the fluid chambers 31, 32 of the one and same hydraulic bushing 12, channels 701 are provided which connect the fluid chambers 31, 32 of the hydraulic bushings 12 between each other. Here an internal fluid channel 33 can, for example, be provided, analogously to FIG. 4. Provision is made in accordance with the invention for an on/off valve 703 to be provided in the channels 701 or in the internal fluid channel 33, as applicable, which can thus adjust a through-flow or a flow resistance between the two fluid chambers 31, 32 for a hydraulic fluid. Thus, for example, the on/off valve 703 can be closed, so that no connection exists between the fluid chambers 31, 32. In particular, the on/off valve 701 can be open, so that a hydraulic connection exists between the fluid chambers 31, 32. These on/off valves 703 are controlled by means of control signals 705. These control signals 705 are formed by the regulatory device 605. In a way analogous to the embodiments in conjunction with FIG. 6, the regulatory device 605 forms these control signals 705 on the basis of the acceleration signals 603. Here again, the acceleration signals 603 detected by the acceleration sensors 601 are filtered and converted for the regulator in real time and as a function of stiffness relationships which are stored in the regulatory device 605 for the A-frame linkage 8, the hydraulic bushings 12, the on/off valves 703 and the connecting pipes, in particular the channels 701 or the internal channel 33, as applicable. The regulatory device 605 comprises, for example, a PI regulator, and from the measured and filtered accelerations and the appropriate setpoint prescriptions forms a difference signal which is the regulatory variable for a control device, not shown here, for the on/off valves 703. In this form of embodiment with the on/off valves 701, the function of turning moment damping makes possible in each case softening or stiffening of the two axle linkages on the wheelset 3, 4 which is out of phase with the hunting oscillation, and thereby actively damps a highly dynamic hunting oscillation of the wheelsets 3, 4. This form of embodiment thus influences in an advantageous way the radial setting behavior on the track. With a suitable switching frequency (, which is determined,) for the hydraulic fluid chambers 31, 32 one can thereby advantageously effectively damp the frequency of the hunting oscillation when the vehicle's ride is unstable, and stabilize the running of the wheelset. The suitable switching frequency is determined, in particular, as a function of the measured wheelset accelerations.

Analogously to FIG. 6, here too it is possible to provide, in a form of embodiment for pressure monitoring which is not shown, a pressure sensor for each coupled fluid chamber 31, 32. Here again, the regulatory device 605 comprises a signal filter, a real time signal filter, a signal computer with measured value converter, in particular a real-time signal computer with measured value converter. The regulatory device 605 comprises in addition a difference calculator with a PI regulator and a setpoint output for a pulse signal converter. Hence the regulatory device 605 comprises in particular a pulse signal converter, and a valve control device for controlling the on/off valves 703. Further, the form of embodiment as shown in FIG. 7 comprises a hydraulic turning moment damper, in the form of the on/off valves 703 on the hydraulic bushings 12 in the A-frame linkage 8, for active stability regulation of the wheelsets 3, 4.

Thus the on/off valves 703 together with the regulatory device 605 form an adjustment facility for adjusting a hydraulic pressure in the fluid chambers 31, 32.

Hence, the inventive thinking lies in particular in a simple application of the previously proven concept of an A-frame linkage in the chassis and its equipping with hydraulic bushings together with their force-related regulation by the influencing and changing, for example imposition, of the hydraulic pressure level in their fluid chambers for the purpose of actively influencing the linkage characteristics of the axle linkages on the wheelsets of the chassis, and for the purpose of utilizing an active stability regulation by the imposition of a pulse pattern which is counter-phase with the hunting oscillation of the wheelset.

Provision is thus made to generate active control forces by the use of a hydraulic pulser. In addition, provision is made for the use of acceleration sensors, real-time signal filters, real-time signal computers together with measured value converters for the purpose of setpoint output for the regulatory device, with difference formers and pulse signal converters for the hydraulic controller and the actuators, in particular the on/off valves. Hence, in accordance with the invention provision is made for the use of hydraulically coupled wheelsets by appropriate hydraulic connection and actuation of the fluid chambers in the hydraulic bushings on the A-frame linkages to steer the wheelsets in the chassis. Advantageously, in accordance with one form of embodiment, provision is made for the application of pressure monitoring, by means of pressure sensors on the coupled fluid chambers, as a safety facility in the event of a failure of the hydraulic bushings and in the case of impermissible leakages in the hydraulic system of the active chassis control. In accordance with the invention, in accordance with one form of embodiment, the formation of an active turning moment damper is advantageously provided for stabilizing the wheelset running. The active chassis linkage and the stability regulation, together with the active turning moment damper, can be applied for single and multi-axle chassis, for undriven and driven chassis, for example bogies.

Figure 8:
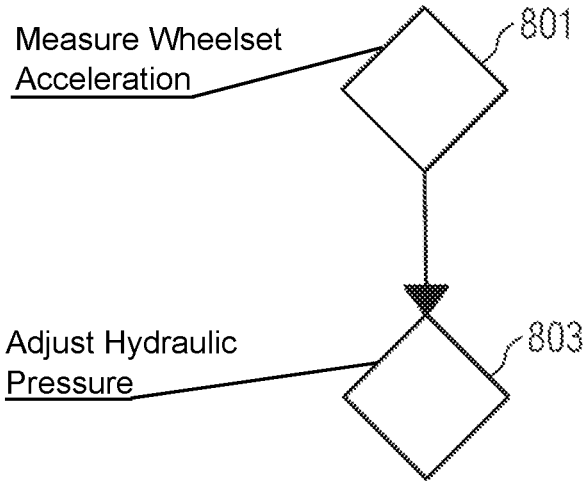
FIG. 8 shows a flow diagram of a method for operating a chassis.

FIG. 8 shows a flow diagram for a method of operating a chassis in accordance with the invention. In accordance with a step 801, a wheelset acceleration is measured for each wheelset by means of the acceleration sensors. In a step 803, the hydraulic pressure in at least one fluid chamber is adjusted as a function of the measured wheelset acceleration.

Figure 9:
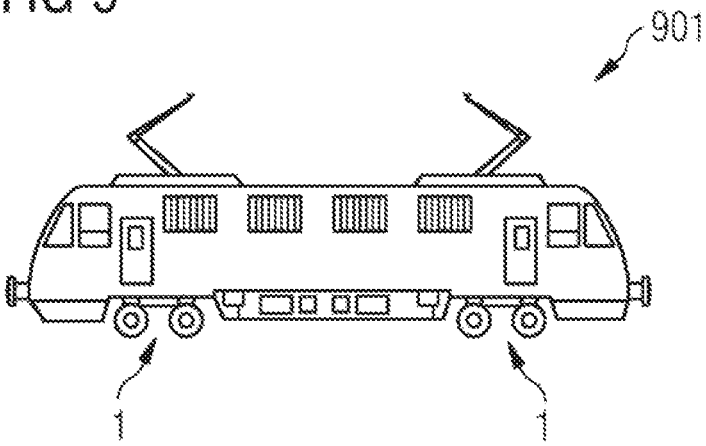
FIG. 9 shows a rail vehicle.

FIG. 9 shows a rail vehicle 901 which comprises the inventive chassis 1.

Although the details of the invention have been more closely illustrated and described by the preferred exemplary embodiments, the invention is not restricted by the examples disclosed and other variants can be derived from it by a specialist without going outside the scope of protection of the invention.

The invention claimed is:

1. A chassis for a rail vehicle, the chassis comprising:

a chassis frame having two sides;

at least one first wheelset and at least one second wheelset supporting said chassis frame, each of said wheelsets having a respective axle and two respective axle bearings;

A-frame linkages each disposed on a respective one of said sides of said chassis frame for horizontal guidance of said axle of a respective one of said wheelsets;

wheelset-side bearings each forming an articulated connection of a respective one of said A-frame linkages to a respective one of said two axle bearings, and two frame-side bearings each forming an articulated connection of a respective one of said A-frame linkages to said chassis frame;

at least one of said bearings connected to each respective A-frame linkage on each side of said chassis frame having a respective one of a plurality of hydraulic bushings with a variable stiffness, said hydraulic bushing having fluid chambers to be filled with a hydraulic fluid, permitting a hydraulic pressure to form in said at least one fluid chamber for adjusting a longitudinal stiffness;

said fluid chambers of said hydraulic bushing including a fluid chamber disposed outwardly in a longitudinal direction and a fluid chamber disposed inwardly in the longitudinal direction;

said outwardly and said inwardly disposed fluid chambers lying opposite one other and being fillable with hydraulic fluid;

fluid channels each connected to a respective one of said fluid chambers for an inward or outward flow of hydraulic fluid into or out of said respective fluid chamber, said fluid channels including external fluid channels interconnecting said hydraulic bushings disposed on the same side of said chassis frame;

said outwardly-disposed fluid chamber of said first wheelset and said inwardly-disposed fluid chamber of said second wheelset being hydraulically coupled to each other, and said inwardly-disposed fluid chamber of said first wheelset and said outwardly-disposed fluid chamber of said second wheelset being hydraulically coupled to each other;

said hydraulic bushings each having a respective internal fluid channel through which said outwardly-disposed fluid chamber and said inwardly-disposed fluid chamber on the same hydraulic bushing are hydraulically coupled to each other;

acceleration sensors each being associated with a respective one of said axle bearings for measuring an acceleration of a respective wheelset; and an adjustment device for adjusting the hydraulic pressure in at least one of said fluid chambers as a function of the measured wheelset acceleration;

said adjustment device being hydraulically coupled to said fluid channels and being configured to adjust an inward or outward flow of hydraulic fluid to permit the hydraulic pressure in said fluid chambers to be adjusted by using outflows or inflows of hydraulic fluid;

said adjustment device being hydraulically coupled to said external fluid channels; and said adjustment device including on/off valves each being associated with a respective one of said internal fluid channels for adjusting a flow of hydraulic fluid through said internal fluid channel.

2. The chassis according to claim 1, wherein said adjustment device is configured to actively impose a turning moment on one of said wheelsets associated with said at least one fluid chamber by adjusting the hydraulic pressure in said at least one fluid chamber.

3. The chassis according to claim 1, wherein said at least one bearing having said at least one fluid chamber is said wheelset-side bearing.

4. The chassis according to claim 1, wherein said adjustment device has a pressure reservoir to be connected to said at least one fluid chamber.

5. The chassis according to claim 1, wherein said adjustment device has a pressure generation device to be connected to said at least one fluid chamber.

6. The chassis according to claim 1, which further comprises a pressure sensor for measuring a hydraulic pressure in one of said fluid chambers.

7. A method for operating a chassis for a rail vehicle, the method comprising the following steps:

providing a chassis including:

a chassis frame having two sides;

at least one first wheelset and at least one second wheelset supporting the chassis frame, each of the wheelsets having a respective axle and two respective axle bearings;

A-frame linkages each disposed on a respective one of the sides of the chassis frame for horizontal guidance of the axle of a respective one of the wheelsets;

wheelset-side bearings each forming an articulated connection of a respective one of the A-frame linkages to a respective one of the two axle bearings, and two frame-side bearings each forming an articulated connection of a respective one of the A-frame linkages to the chassis frame;

at least one of the bearings connected to each respective A-frame linkage on each side of the chassis frame having a respective one of a plurality of hydraulic bushings with a variable stiffness, the hydraulic bushing having fluid chambers to be filled with a hydraulic fluid, permitting a hydraulic pressure to form in the at least one fluid chamber for adjusting a longitudinal stiffness;

the fluid chambers of the hydraulic bushing including a fluid chamber disposed outwardly in a longitudinal direction and a fluid chamber disposed inwardly in the longitudinal direction;

the outwardly and the inwardly disposed fluid chambers lying opposite one other and being fillable with hydraulic fluid;

fluid channels each connected to a respective one of the fluid chambers for an inward or outward flow of hydraulic fluid into or out of the respective fluid chamber, the fluid channels including external fluid channels interconnecting the hydraulic bushings disposed on the same side of the chassis frame;

the outwardly-disposed fluid chamber of the first wheelset and the inwardly-disposed fluid chamber of the second wheelset being hydraulically coupled to each other, and the inwardly-disposed fluid chamber of the first wheelset and the outwardly-disposed fluid chamber of the second wheelset being hydraulically coupled to each other;

the hydraulic bushings each having a respective internal fluid channel through which the outwardly-disposed fluid chamber and the inwardly-disposed fluid chamber on the same hydraulic bushing are hydraulically coupled to each other;

acceleration sensors each being associated with a respective one of the axle bearings for measuring an acceleration of a respective wheelset; and an adjustment device for adjusting the hydraulic pressure in at least one of the fluid chambers as a function of the measured wheelset acceleration;

the adjustment device being hydraulically coupled to the fluid channels and being configured to adjust an inward or outward flow of hydraulic fluid to permit the hydraulic pressure in the fluid chambers to be adjusted by using outflows or inflows of hydraulic fluid;

the adjustment device being hydraulically coupled to the external fluid channels;

the adjustment device including on/off valves each being associated with a respective one of the internal fluid channels for adjusting a flow of hydraulic fluid through the internal fluid channel;

measuring a wheelset acceleration for each wheelset by using the acceleration sensors; and adjusting the hydraulic pressure in at least one of the fluid chambers as a function of the measured wheelset acceleration.

8. A rail vehicle, comprising a chassis according to claim 1.

* * * * *